US009261843B2

(12) United States Patent
Ito

(10) Patent No.: US 9,261,843 B2
(45) Date of Patent: Feb. 16, 2016

(54) IMAGE FORMING APPARATUS THAT CORRECTS RELATIONSHIP BETWEEN NUMBER OF PIXELS AND USAGE AMOUNT OF DEVELOPER

(71) Applicant: KYOCERA Document Solutions Inc., Osaka (JP)

(72) Inventor: Shigeharu Ito, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/661,710

(22) Filed: Mar. 18, 2015

(65) Prior Publication Data

US 2015/0277327 A1 Oct. 1, 2015

(30) Foreign Application Priority Data

Mar. 27, 2014 (JP) ..... 2014-066011

(51) Int. Cl.
*G03G 15/08* (2006.01)
*G03G 15/00* (2006.01)

(52) U.S. Cl.
CPC ..... *G03G 15/556* (2013.01)

(58) Field of Classification Search
CPC ..... G03G 15/553; G03G 15/556
See application file for complete search history.

(56) References Cited

U.S. PATENT DOCUMENTS

| | | | | |
|---|---|---|---|---|
| 6,584,291 | B1 | 6/2003 | Yamamoto | 399/27 |
| 2006/0007509 | A1 * | 1/2006 | Imagawa et al. | 358/504 |
| 2006/0204257 | A1 * | 9/2006 | Kawano et al. | 399/27 |

* cited by examiner

*Primary Examiner* — G. M. Hyder
(74) *Attorney, Agent, or Firm* — Stein IP, LLC

(57) ABSTRACT

An image forming apparatus includes an image forming portion, a storage portion, a density measurement portion, a calibration portion, and a correction portion. The image forming portion is configured to form an image by using a developer. The storage portion is configured to store a relationship between a number of pixels formed by the image forming portion and a usage amount of the developer. The density measurement portion is configured to perform measurement of a density of a patch image formed by the image forming portion. The calibration portion is configured to perform calibration based on the measured density. The correction portion is configured to perform correction of the relationship between the number of pixels and the usage amount of the developer, the relationship being stored in the storage portion, by using differences in number of pixels at a plurality of previously set densities between before and after the calibration.

4 Claims, 5 Drawing Sheets

IMAGE FORMING APPARATUS THAT CORRECTS RELATIONSHIP BETWEEN NUMBER OF PIXELS AND USAGE AMOUNT OF DEVELOPER

INCORPORATION BY REFERENCE

This application is based on and claims the benefit of priority from Japanese Patent Application No. 2014-066011 filed on Mar. 27, 2014, the contents of which are hereby incorporated by reference.

BACKGROUND

The present disclosure relates to an image forming apparatus that forms an image on a sheet by using a developer such as toner and ink.

In an image forming apparatus using toner, ink, etc. as a developer, an image is printed on a sheet by using a developer accommodated in a cartridge. In such an image forming apparatus, it is necessary to calculate a remaining amount of developer accommodated in the cartridge and urge a user to replace the cartridge with a new one when the remaining amount falls below a predetermined value. If this calculation of the remaining amount is not accurate, it may affect the replacement of cartridges, etc. and invite degradation of reliability of the apparatus.

In conventional technologies, for example, a number of pixels is used to calculate a toner consumption amount, and a toner remaining amount in a cartridge is calculated from the toner consumption amount.

SUMMARY

According to one aspect of the present disclosure, an image forming apparatus includes an image forming portion, a storage portion, a density measurement portion, a calibration portion, and a correction portion. The image forming portion is configured to form an image by using a developer. The storage portion is configured to store a relationship between a number of pixels formed by the image forming portion and a usage amount of the developer. The density measurement portion is configured to perform measurement of a density of a patch image formed by the image forming portion. The calibration portion is configured to perform calibration processing based on the density obtained as a result of the measurement. The correction portion is configured to perform correction of the relationship between the number of pixels and the usage amount of the developer, the relationship being stored in the storage portion, by using differences in number of pixels at a plurality of previously set densities between before and after the calibration processing.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION

Hereinafter, an image forming apparatus according to one embodiment of the present disclosure will be described with reference to the accompanying drawings. The present embodiment will be described dealing with, as an example, an electro-photographic image forming apparatus that uses a toner as a developer. The present disclosure is also applicable to an inkjet printer which uses ink.

Figure 1:
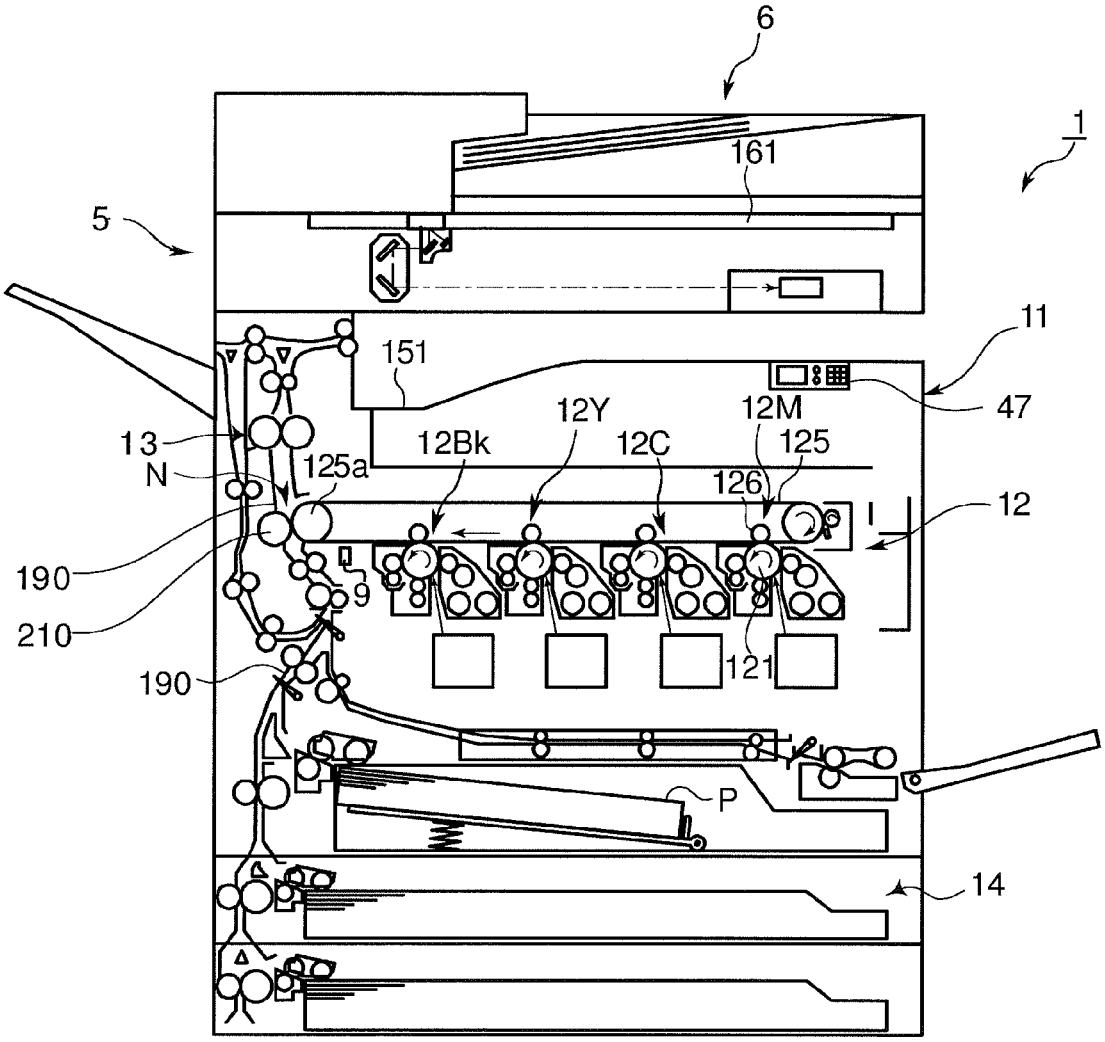
FIG. 1 is a front sectional view showing a structure of an image forming apparatus.

FIG. 1 is a front sectional view showing a structure of an image forming apparatus 1 according to one embodiment of the present disclosure. The present embodiment will be described dealing with a color image forming apparatus as the image forming apparatus 1 as an example, but the image forming apparatus 1 can also be a monochrome image forming apparatus. The image forming apparatus 1 is constituted by an apparatus main body 11 including an operation portion 47, an image forming portion 12, a fixing portion 13, a sheet feeding portion 14, a document feeding portion 6, a document reading portion 5, etc.

The operation portion 47 receives, from an operator, instructions regarding various operations and processing that the image forming apparatus 1 is capable of performing, such as instructions to perform an image forming operation, a document reading operation, etc.

When the image forming apparatus 1 performs the document reading operation, the document reading portion 5 optically reads an image of a document fed by the document feeding portion 6 or an image of a document placed on a document placing glass 161, and generates image data.

When the image forming apparatus 1 performs the image forming operation, based on the image data generated through the document reading operation, etc., the image forming portion 12 forms a toner image on a sheet of recording paper P as a recording medium fed from the sheet feeding portion 14. In color printing, a magenta image forming unit 12M, a cyan image forming unit 12C, a yellow image forming unit 12Y, and a black image forming unit 12Bk of the image forming portion 12 each form a toner image on a photosensitive drum 121, based on an image of a corresponding one of color components constituting the image data, through steps of charging, exposing, and developing. The toner images are transferred by a primary transfer roller 126 onto an intermediate transfer belt 125.

The toner images of these colors transferred onto the intermediate transfer belt 125 are superimposed on each other on the intermediate transfer belt 125 at adjusted transfer timings, and become a color toner image. The color toner image formed on a surface of the intermediate transfer belt 125 is transferred by a secondary transfer roller 210 onto a sheet of recording paper P conveyed along a conveyance path 190 from the sheet feeding portion 14, at a nip portion N where the intermediate transfer belt 125 is sandwiched between the secondary transfer roller 210 and a driving roller 125*a*. Thereafter, the fixing portion 13 fixes the toner image on the recording paper P to the recording paper P by thermoscompression bonding. The recording paper P that has undergone the fixing and has a color image formed thereon is ejected onto an ejection tray 151.

A density sensor 9 (a density measurement portion) is provided for measuring a density (toner density) of a patch image for calibration transferred onto the intermediate transfer belt 125, and the density sensor 9 has, for example, a light emitting portion configured to irradiate the patch image with inspection light and a light receiving portion configured to receive the inspection light reflected from the patch image. The density sensor 9 detects the density of the patch image based on an amount of light received by the light receiving portion.

Conventional methods for detecting a remaining amount of toner accommodated in a toner cartridge include, for example, a method in which remaining amount detecting means is provided inside a toner cartridge, and a method in which a toner remaining amount is obtained by calculating a toner consumption amount according to dots (a number of pixels) formed by the image forming portion 12.

With such conventional methods, however, there are cases where the relationship between the number of pixels and the toner consumption amount changes due to factors such as aging degradation of the image forming portion 12 and an installation environment of the image forming apparatus 1. If no consideration is given to the change in relationship between the number of pixels and the toner consumption amount, and a same conversion formula continues to be used to calculate the toner remaining amount, there arises a gap between a calculated toner remaining amount and an actual toner remaining amount. This may make it impossible to inform a user of a need to replace toner cartridges at an appropriate timing, and thus may degrade reliability of the image forming apparatus 1.

To prevent these inconvenience, the relationship between the number of pixels and the toner consumption amount is corrected by using a density of a patch image formed at a time of calibration. Thereby, it is possible to update the relationship between the number of pixels and the toner consumption amount to a latest version each time calibration is performed, and thus to increase accuracy of the toner remaining amount.

Figure 2:
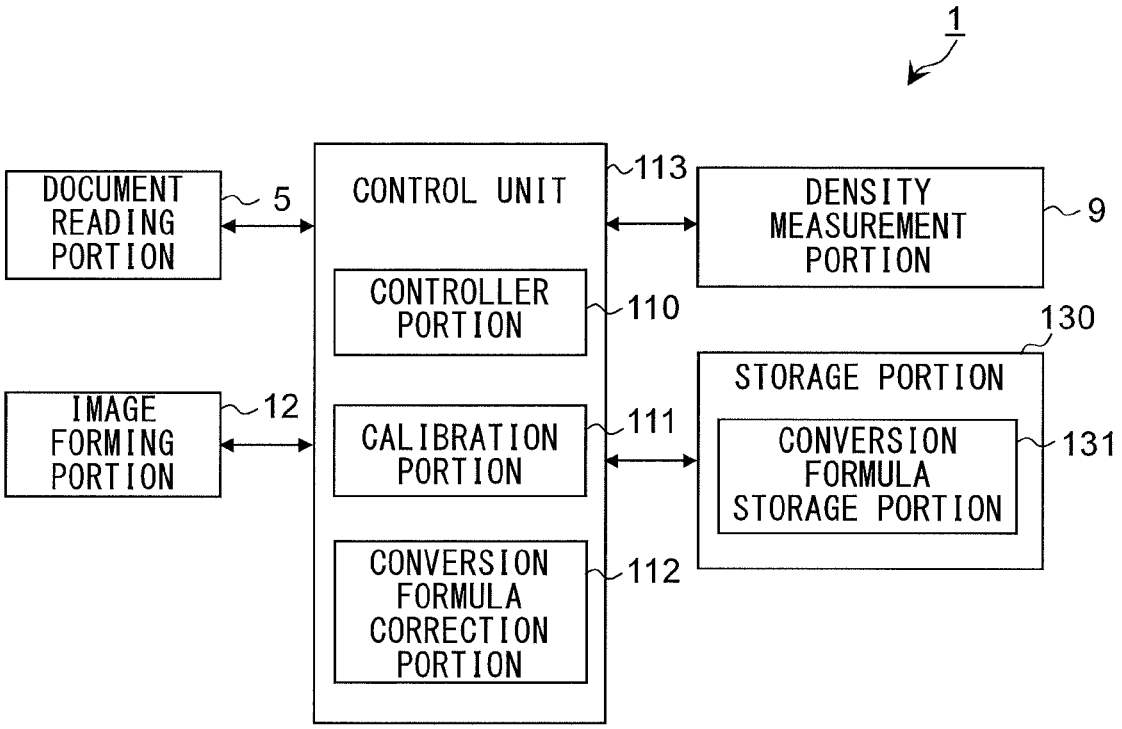
FIG. 2 is a functional block diagram showing a main internal configuration of the image forming apparatus.

FIG. 2 is a functional block diagram showing a main internal configuration of the image forming apparatus 1. The image forming apparatus 1 includes a control unit 113, the document reading portion 5, the image forming portion 12, the density measurement portion 9, and the storage portion 130. Here, the same signs are given to the same components as those illustrated in FIG. 1 and descriptions thereof will be omitted.

The storage portion 130 stores programs and data necessary for operations of the image forming apparatus 1, and in the present embodiment, the storage portion 130 has a conversion formula storage portion 131. The conversion formula storage portion 131 stores conversion formulae each for calculating a toner consumption amount per unit area from a number of pixels formed by the image forming portion 12. Here, instead of the conversion formulae, any data may be stored in a form of, for example, data tables, as long as the data indicates the relationship between the number of pixels and the toner consumption amount.

The control unit 113 reads various programs, performs processing, outputs an instruction signal to each functional portion, and transfers data, for example, hereby performing overall control of the image forming apparatus 1. The control unit 113 has a control portion 110, a calibration portion 111, and a conversion formula correction portion 112 (correction portion).

The control portion 110 is in charge of overall operation control of the image forming apparatus 1.

The calibration portion 111 periodically causes the image forming portion 12 to form patch images of different densities, and if the densities of the patch images do not coincide with set densities, the calibration portion 111 performs density adjustment by changing an image processing parameter, for example, and performs color matching processing so that an image can be formed in accurate colors. The numbers of pixels necessary to cause the densities of the patch images to coincide with the set densities are increased or decreased by changing the image processing parameter for the calibration processing.

The conversion formula correction portion 112 calculates differences of the numbers of pixels at a plurality of previously set densities (hereafter referred to as "set densities") between before and after the calibration processing, and corrects conversion formulae stored in the conversion formula storage portion 131 by using the differences.

After the calibration processing performed by the calibration portion 111, the control portion 110 causes the image forming portion 12 to form patch images for calibration as latent images based on the image processing parameter used in the calibration processing. The conversion formula correction portion 112 acquires numbers of pixels used by the image forming portion 12 in forming the latent images, and corrects the conversion formulae by using the acquired numbers of pixels as numbers of pixels after the calibration processing.

Figure 3:
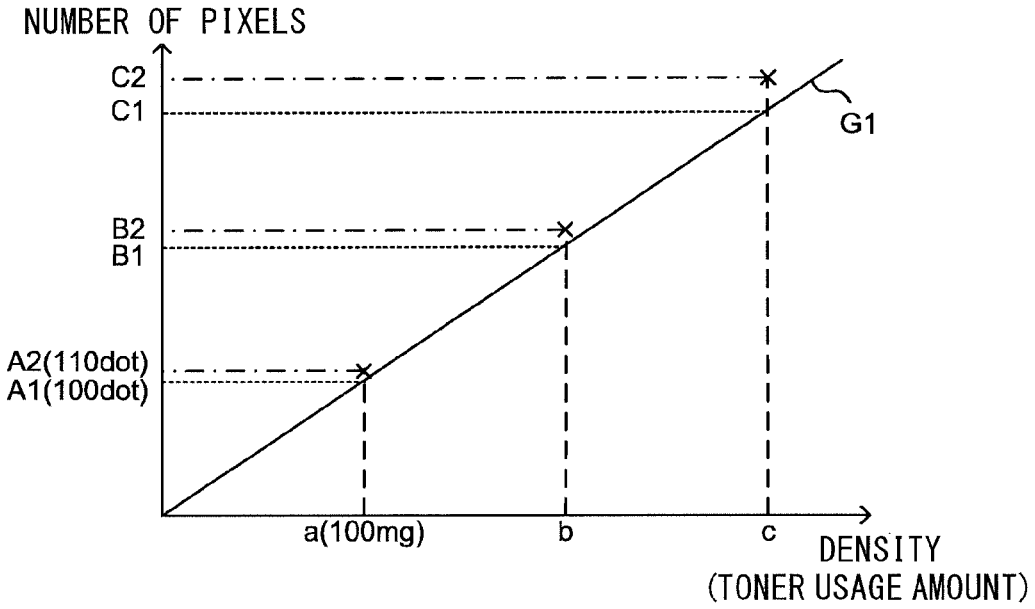
FIG. 3 is a graph showing a relationship between a density and a number of pixels.

A specific description will be given of the processing performed by the conversion formula correction portion 112. FIG. 3 is a graph showing a relationship between the density and the number of pixels. Here, graph G1 indicates a relationship between the density and the number of pixels before calibration processing.

Assume that the number of pixels necessary to form an image having a density "a", for example, changes from A1 to A2 before and after calibration. For a simple description, assume that the number of pixels A1 is 100 pixels and the number of pixels A2 is 110 pixels.

In addition, assume that the density and the toner usage amount are uniquely determined in the present embodiment such that, for example, the toner usage amount per unit area necessary to obtain an image having the density "a" is 100 mg.

In a case where the values are set as above, the toner usage amount per pixel before the calibration is 1.0 mg/pixel, which is calculated by 100 mg÷ 100 pixels, and the toner usage amount per pixel after the calibration is 0.9 mg/pixel, which is calculated by 100÷110 pixels. That is, the toner usage amount per pixel changes from 1.0 mg to 0.9 mg. Since the toner usage amount per pixel changes before and after the calibration in this way, it is necessary to correct the relationship between the number of pixels and the toner usage amount each time calibration is performed.

For this purpose, the conversion formula correction portion 112 corrects the relationship between the number of pixels and the toner usage amount by using differences in numbers of pixels at set densities (densities "a", "b", and "c") between before and after calibration. That is, the conversion formula correction portion 112 calculates a difference (A2−A1) in number of pixels at density "a" between before and after the calibration, a difference (B2−B1) in number of pixels at density "b" between before and after the calibration, and a difference (C2−C1) in number of pixels at density "c" between before and after the calibration. Then, by using these differences, the conversion formula correction portion 112 corrects the relationship between the number of pixels and the toner usage amount, the relationship being stored in the conversion formula storage portion 131.

Figure 4:
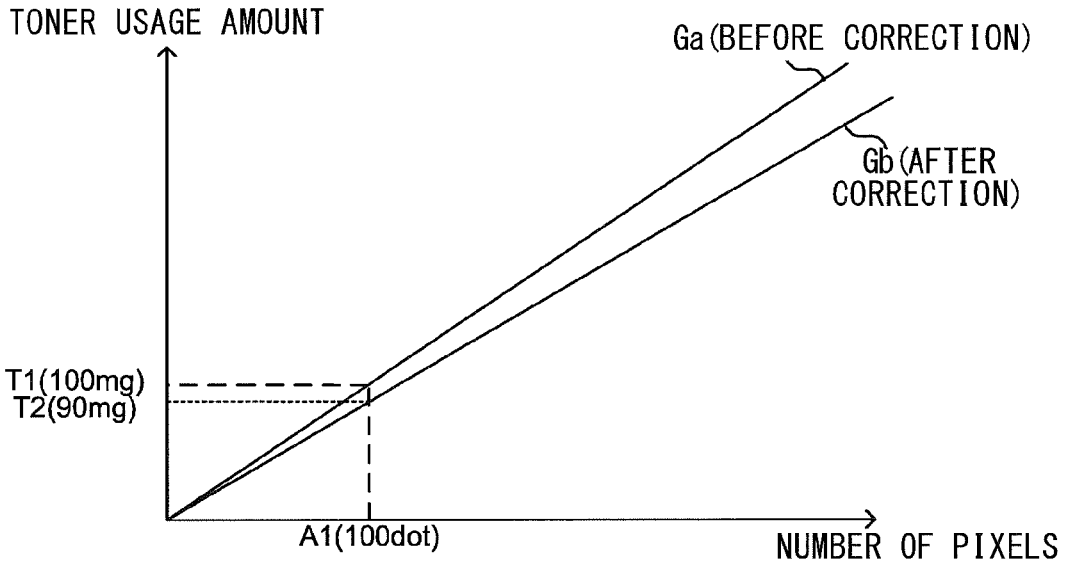
FIG. 4 is a graph showing a relationship between a toner usage amount and a number of pixels.

FIG. 4 is a diagram showing relationships between the number of pixels and the toner usage amount, and the conversion formula storage portion 131 stores graph Ga or graph Gb as a conversion formula or a data table. Graph Ga indicates before the calibration, and graph Gb indicates after the calibration, graph Gb showing a result of correction performed on graph Ga by the conversion formula correction portion 112 by using the above described method.

Before the calibration, the toner usage amount necessary to form an image of A1 (=100 pixels) is 100 mg (=100 pixels× 1.0 mg/pixel). After the calibration, however, the toner usage amount changes to 90 mg (=100 pixels×0.9 mg/pixel). Since the toner usage amount necessary to form an image of the same number of pixels differs between before and after the calibration in this way, correction of the relationship between the number of pixels and the toner usage amount, performed by the conversion formula correction portion 112 each time calibration is performed, contributes to accurate calculation of the toner remaining amount.

Figure 5:
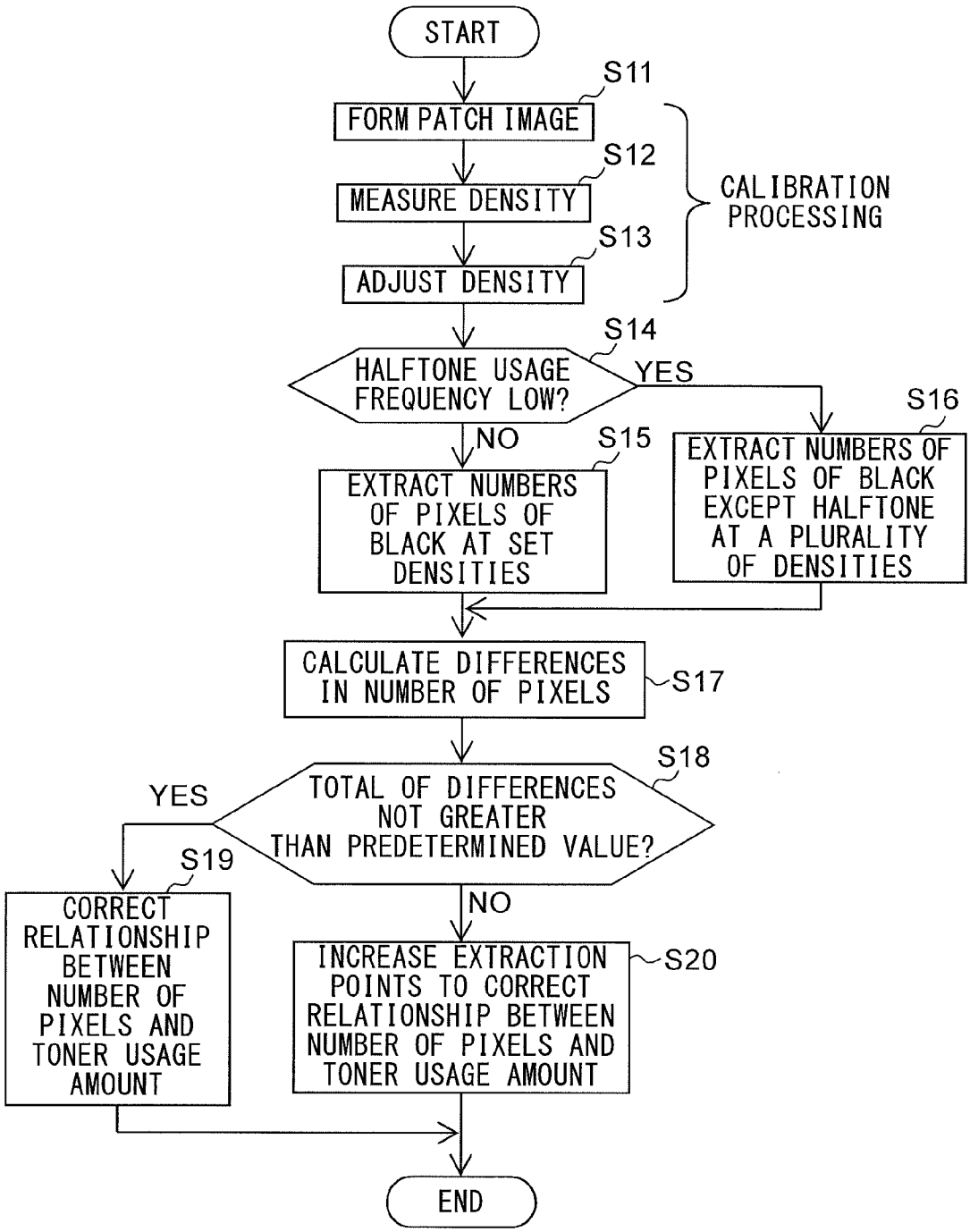
FIG. 5 is a flow chart showing a flow of conversion formula correction processing performed by a conversion formula correction portion.

FIG. 5 is a flow chart showing a flow of the conversion formula correction processing performed by the conversion formula correction portion 112. First, the calibration portion 111 causes the image forming portion 12 to form patch images for calibrations (Step S11), and causes the density measurement portion 9 to measure densities of the patch images (Step S12). Then, the calibration portion 111 performs the calibration based on the measured densities received from the density measurement portion 9 (Step S13).

And normally, in a case where image formation is frequently performed by using halftone (No in Step S14), the conversion formula correction portion 112 extracts, from a result of the calibration, numbers of pixels at previously set densities in black (for example, the densities "a", "b", and "c" in FIG. 3) (Step S15), and calculates differences in number of pixels at the set densities between before and after the calibration (Step S17). Here, as mentioned above, the conversion formula correction portion 112 acquires the numbers of pixels used by the image forming portion 12 in forming the latent images by using the image processing parameter changed by the calibration processing, and uses the acquired numbers as the numbers of pixels after the calibration processing (the same applies to Step S16 which will be described later).

The storage portion 130 stores the numbers of pixels at all of the set densities before the calibration. In calculating differences in number of pixels, the conversion formula correction portion 112 reads the numbers of pixels before the calibration from the storage portion 130.

In a case where a total of the differences in number of pixels at the set densities is equal to or smaller than a previously set value (hereafter referred to as "predetermined value") (Yes in Step S18), the conversion formula correction portion 112 corrects the conversion formulae by using the differences in number of pixels at the set densities (Step S19).

On the other hand, when the total of the differences in number of pixels at the set densities is greater than the predetermined value (NO in Step S18), the correction of the conversion formulae is performed with an increased number of extraction points for accuracy.

That is, the conversion formula correction portion 112 extracts numbers of pixels at an additional plurality of densities besides the above-mentioned set densities (densities "a", "b", and "c"), and calculates differences in number of pixels between before and after the calibration.

Then, the conversion formula correction portion 112 corrects the conversion formulae by using not only the differences in number of pixels at the set densities but also the differences in number of pixels at the additional plurality of densities (Step S20). Thus, in the case where the total of the differences in number of pixels at the set densities is large, it is possible to perform a more accurate correction by correcting the conversion formulae with the increased number of extraction points.

Figure 6:
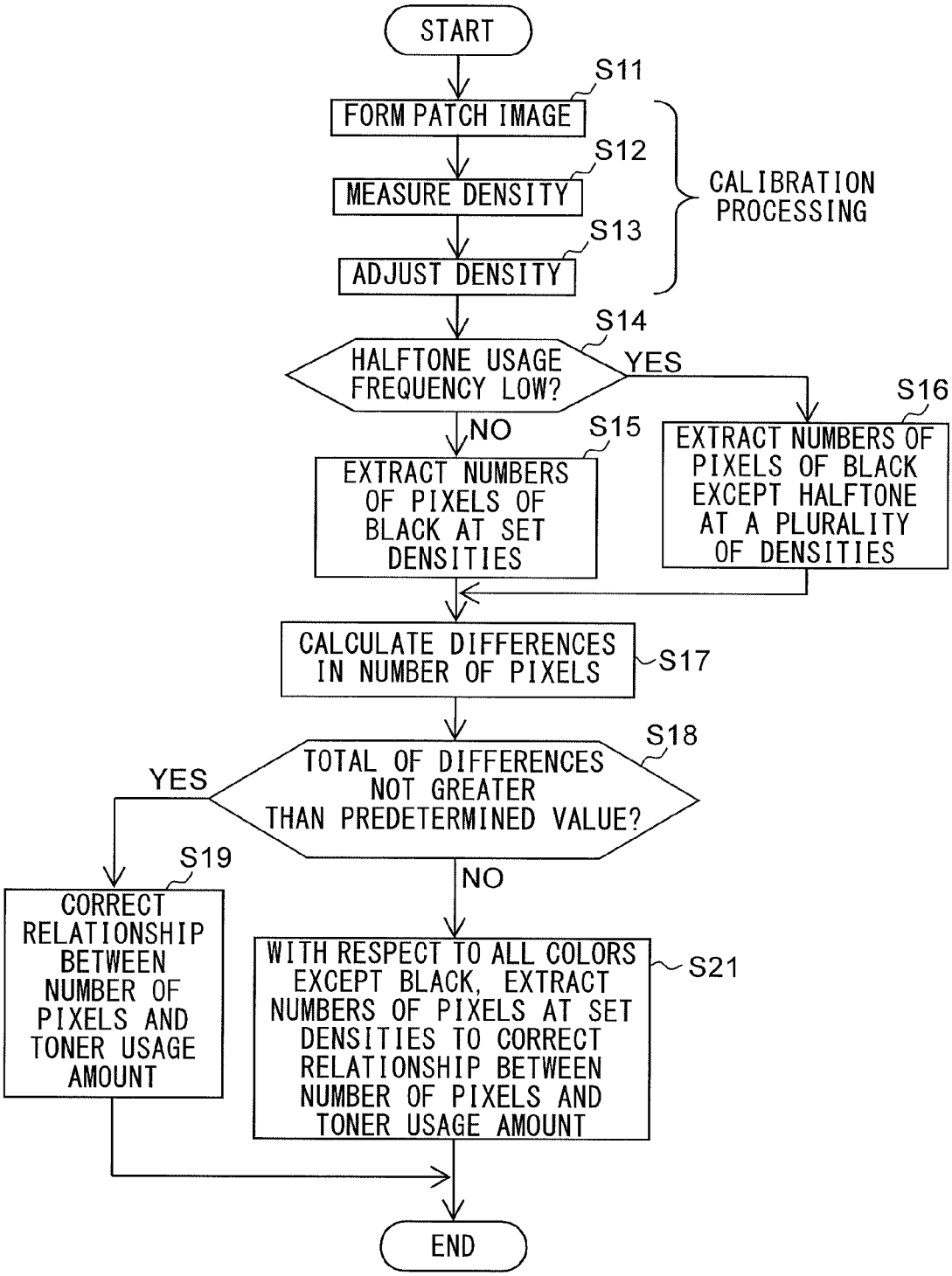
FIG. 6 is a flow chart showing a flow of another conversion formula correction processing performed by the conversion formula correction portion.

Here, instead of increasing the extraction points to perform the correction of the conversion formulae, the conversion formula correction portion 112 may perform another correction. For example, FIG. 6 shows an example where the conversion formula correction portion 112 performs another correction. Step S11 to Step S19 in FIG. 6 are the same as those in FIG. 5. FIG. 6 includes Step S21 instead of Step 20. In a case where the image forming apparatus 1 is capable of performing full-color printing, as shown in FIG. 6, the conversion formula correction portion 112 may calculate the differences in number of pixels at the set densities with respect to all colors except black (cyan, magenta, and yellow, for example), and correct the conversion formulae (Step S21). Also, with respect to all of the colors, the conversion formula correction portion 112 may calculate the differences in number of pixels only at the set densities (densities "a", "b", and "c") to correct the conversion formulae, or may use the differences in number of pixels at an additional plurality of densities besides the set densities to correct the conversion formulae. Thereby, it is possible to correct the conversion formulae for all of the colors more accurately.

In a case where halftone usage frequency is low, that is, the frequency at which a photo image, etc. is printed is low (YES in Step S14), the conversion formula correction portion 112 extracts, from the result of calibration, numbers of pixels of black except halftone at a plurality of densities (Step S16), and corrects the conversion formula. Thereby, it is possible to omit correction of the relationship between the number of pixels and the toner usage amount at halftone that is not used frequently, and this helps to reduce processing load.

As has been described above, by correcting the conversion formula between the number of pixels and the toner usage amount each time calibration is performed, it is possible to always maintain the accuracy of the toner remaining amount, and thus to inform the user of a need to replace toner cartridges at an appropriate timing.

In the case where the usage frequency of halftone as in photo images is low, it is possible to reduce the processing load by correcting the conversion formula with respect to a range excluding halftone.

In the case the total of the differences in number of pixels at the set densities is greater than the predetermined value, it is possible to accurately correct the conversion formulae by, for example, using increased number of extraction points to correct the conversion formulae, or correcting the conversion formula by calculating differences in number of pixels at the set densities with respect to all of the colors.

What is claimed is:

1. An image forming apparatus, comprising:

an image forming portion configured to form an image by using a developer;

a storage portion configured to store a relationship between a number of pixels formed by the image forming portion and a usage amount of the developer;

a density measurement portion configured to perform measurement of a density of a patch image formed by the image forming portion;

a calibration portion configured to perform calibration processing based on the density obtained as a result of the measurement; and a correction portion configured to perform correction of the relationship between the number of pixels and the usage amount of the developer, the relationship being stored in the storage portion, by using differences in number of pixels at a plurality of previously set densities between before and after the calibration processing, wherein in a case where a frequency at which the image forming portion forms an image in halftone is equal to or lower than a predetermined frequency, the correction portion does not perform the correction of the halftone.

2. The image forming apparatus according to claim 1, wherein when a total of the differences is greater than a previously set value, the correction portion calculates a difference in number of pixels at another density besides the plurality of previously set densities between before and after the calibration processing, and performs correction of the relationship between the number of pixels and the usage amount of the developer by further using the difference.

3. The image forming apparatus according to claim 1, wherein the image forming portion is configured to form a color image by using developers of a plurality of colors;

the storage portion is configured to store the relationship between the number of pixels formed by the image forming portion and the usage amount of the developer with respect to each of the plurality of colors; and by using differences in number of pixels of a previously set color at the plurality of previously set densities between before and after the calibration processing, the correction portion performs, with respect to each of the plurality of colors, correction of the relationship between the number of pixels and the usage amount of the developer, the relationship being stored in the storage portion.

4. The image forming apparatus according to claim 3, wherein when a total of the differences is greater than a previously set value, the correction portion calculates differences in number of pixels of each of the plurality of colors at the previously set densities between before and after the calibration processing, and by further using the differences, the correction portion performs, with respect to each of the plurality of colors, correction of the relationship between the number of pixels and the usage amount of the developer, the relationship being stored in the storage portion.

* * * * *